US005156530A

United States Patent [19]

Rütschle

[11] Patent Number: 5,156,530

[45] Date of Patent: Oct. 20, 1992

[54] COMPRESSED-AIR GENERATOR WITH ADJUSTABLE PRESSURE OUTPUT AND/OR ADJUSTABLE AIR THROUGHPUT

[75] Inventor: Eugen Rütschle, Mühlheim, Fed. Rep. of Germany

[73] Assignee: Chiron-Werke GmbH & Co., Fed. Rep. of Germany

[21] Appl. No.: 639,198

[22] Filed: Jan. 9, 1991

[30] Foreign Application Priority Data

Aug. 17, 1990 [DE] Fed. Rep. of Germany ... 9011947[U]

[51] Int. Cl.[5] ..... F04B 39/00

[52] U.S. Cl. ..... 417/234; 417/423.14; 200/333; 200/336; 200/564

[58] Field of Search ..... 200/304, 333, 336, 564; 417/234, 411, 423.14, 410, 415, 423.7, 43

[56] References Cited

U.S. PATENT DOCUMENTS 3,527,914 9/1970 Spacek ..... 200/333
4,060,182 11/1977 Kiruchi ..... 417/423.14
4,269,571 5/1981 Shikutani et al. ..... 417/234
4,624,178 11/1986 Keating ..... 200/333 X
4,715,787 12/1987 Hung ..... 417/234 X
4,785,198 11/1988 Chin-Hsiang ..... 417/234 X
4,810,169 3/1989 Kranzle ..... 417/234 X

FOREIGN PATENT DOCUMENTS 2703257 8/1978 Fed. Rep. of Germany ..... 417/411

*Primary Examiner*—Leonard E. Smith
*Attorney, Agent, or Firm*—Pretty, Schroeder, Brueggemann & Clark

[57] ABSTRACT

A compressed-air generator with adjustable pressure output and/or adjustable air throughput has a housing (11) and a fan motor arranged in the housing (11) below the top side (27) thereof. Further provided is an adjustment member which may be adjusted by way of a rotary knob (45) and which is provided for adjustment of the pressure output and/or the air throughput. In the compressed-air generator (8), a protective apparatus (47) at least partially covering the rotary knob (45) is provided, with the rotary knob (45) preferably being arranged on the top side (27) of the housing (11) (FIG. 1).

5 Claims, 4 Drawing Sheets

COMPRESSED-AIR GENERATOR WITH ADJUSTABLE PRESSURE OUTPUT AND/OR ADJUSTABLE AIR THROUGHPUT

The invention relates to a compressed-air generator with adjustable pressure output and/or adjustable air throughput, having a housing, a fan motor arranged in the housing below the top side thereof and an adjustment member which may be adjusted by way of a rotary knob and which is provided for adjustment of the pressure output and/or the air throughput.

A compressed-air generator of the type mentioned above is known as a product of the Applicant.

In the known compressed-air generator, there is provided as the adjustment member a potentiometer which is part of an electronic circuit serving to regulate the speed of the fan motor. The rotary knob is pushed onto the actuating shaft of the potentiometer from the outside, this actuating shaft projecting laterally out of the housing of the compressed-air generator. The speed of the fan motor and thus the power output and/or the air throughput of the known compressed-air generator can be adjusted by way of the rotary knob.

It is known to provide a handle on the top side of the housing in order to facilitate transport. For cooling of the electronic circuit, some of the intake air is fed to the circuit via a bypass and is then guided out of the housing through a blow-out opening in the direction of the handle.

During transport or when using the known compressed-air generator, it happens repeatedly that the rotary knob is subjected to stress from impact, whether because the housing, together with the rotary knob, is knocked unintentionally, for example against a ladder, or because when transporting awkward objects on a building lot for example a bucket or a plank is knocked against the rotary knob. The rotary knob, which is held solely by the shaft of the potentiometer, transmits the impact stress on to the potentiometer. In the case of stress in the radial direction this results in the potentiometer shaft being bent askew or even broken off. In the case of an axial stress of the rotary knob, the force is even passed into the potentiometer, which may result in the boards in the interior of the potentiometer being bent.

In all these cases, the potentiometer is irreparably destroyed and the known compressed-air generator is no longer operational. The potentiometer must be replaced, for which purpose a specialist workshop is generally sought.

Furthermore, a disadvantage in the known compressed-air generator is the fact that the air used for cooling the electronic circuit leaves the housing in the direction of the handle. The air used for cooling can in fact be heated when it passes over the electronic circuit to such an extent that the air emerging from the blow-out opening is at a temperature unpleasant for people. Since the known compressed-air generator is regularly transported while it is also operating, the result is that the user burns his hand and drops the housing. In this case too, the laterally projecting rotary knob can be subjected to forces great enough to result in destruction of the potentiometer.

The invention is thus based on the object of further developing a compressed-air generator of the type mentioned at the outset such that the danger of damaging the adjustment member is reduced.

This object is achieved, in accordance with the invention, in that a protective apparatus at least partially covering the rotary knob is provided, with the rotary knob preferably being arranged on the top side of the housing.

The object on which the invention is based is completely achieved in this manner. Because, in the case of the novel compressed-air generator, the rotary knob is arranged on the top side of the housing, the danger of knocking for example against a wall or a ladder laterally with the rotary knob is eliminated. Because of the protective apparatus at least partially covering the rotary knob, the danger of knocking against the rotary knob by means of an object carried past the compressed-air generator is also considerably reduced. As a rule, the impact will be against the protective apparatus. On the other hand, since the protective apparatus only covers the rotary knob partially, the latter is always accessible to the user.

In a preferred embodiment of the inventive compressed-air generator, the protective apparatus includes a protective sleeve which largely covers the rotary knob in the region of its peripheral surface and which is connected to the housing with form fit.

This measure has the advantage that the stress from impact or being knocked taken up by the protective sleeve is passed into the housing without stressing the rotary knob and thus the adjustment member. Since the protective sleeve largely covers the peripheral surface of the rotary knob, it is not possible for relatively large objects such as a bucket or a lath to knock against the rotary knob.

In the case of the novel compressed-air generator, it is also preferable for the protective sleeve to be open towards the top and to project upwards above the rotary knob in the direction of the longitudinal axis thereof such that the protective sleeve extends to above the top side of the rotary knob.

This measure has the advantage that even if the housing or the protective sleeve is knocked from above, the rotary knob cannot be hit since the protective sleeve projects above it.

Moreover, it is preferable if the protective apparatus has a holding means, frictionally engaged therewith, for the This measure has the advantage that even forceful knocks which displace the protective apparatus with respect to the housing do not result in stress on the adjustment member since the latter moves with the holding means and thus with the protective apparatus.

In a preferred embodiment of the novel compressed-air generator, the protective sleeve is formed as a hollow cylinder and has a continuous wall in which there is provided an upwardly widening V-shaped cutout through which a section of the peripheral surface of the rotary knob is accessible from the outside.

As a result of this measure, the rotary knob is protected over the majority of its peripheral surface even against impacts with pointed objects such as a screwdriver. The peripheral surface of the rotary knob can be grasped through the cutout provided in the wall of the protective sleeve and the rotary knob can thus be adjusted.

In this example embodiment, it is preferable if the peripheral surface of the rotary knob is fluted and if the V-shaped cutout extends at its upper section over an angular region of less than 130°, related to the longitudinal axis, and at its lower section over a correspondingly dimensioned angular region of less than 100°.

This measure provides the advantage that, as a result of the fluting, only a small region of the peripheral surface has to be accessible in order to be able to turn the rotary knob. Thus, the cutout can be provided in a small angular region, which considerably increases the protective action of the protective sleeve against knocks from all sides.

In a further embodiment of the novel compressed-air generator, a handle is provided on the top side of the housing between the front side thereof and the rear side thereof, with the protective sleeve being arranged in the region of the front side and the cutout being aligned in the longitudinal direction of the housing and pointing towards the handle.

This measure has the advantage that when transporting the novel compressed-air generator the region of the rotary knob exposed behind the cutout is covered by the hand of the carrier and thus protected. This means that it is no longer possible to exert a force on the rotary knob from one side only. What might be called an "all-around" protection is achieved.

Furthermore, it is preferable if the adjustment member is cooled by way of an air stream for which at least one blow-out opening pointing laterally away from the handle is provided on the housing.

This measure advantageously prevents the carrier from burning his hand when transporting the operating compressed-air generator and thus dropping the compressed-air generator. This means that the housing can no longer fall and thus by unhappy chance hit a projecting edge such that the rotary knob is subjected to stress despite the protective apparatus.

Furthermore, it is preferable if the protective sleeve and the holding means for the adjustment member are made in one piece from a shock-resistant material.

This measure has the advantage that even in the case of forceful knocks against the protective sleeve the latter is not destroyed. On the other hand, this stress results in the protective sleeve and the holding means moving together with respect to the housing so that no force is exerted on the adjustment member itself.

A further embodiment is distinguished by the fact that the rotary knob is provided with a circular cross section and that the protective sleeve has an internal diameter only slightly larger than the rotary knob as regards its external diameter.

These measures advantageously have the effect that when pressure is exerted on the region of the peripheral surface of the rotary knob accessible through the cutout in the protective sleeve the rotary knob bears against the inner wall of the protective sleeve. Since the internal diameter of the protective sleeve is only slightly larger than the external diameter of the rotary knob, it is not possible to subject the rotary knob to such a stress that forces are passed into the adjustment member. The rotary knob is closely surrounded by the protective sleeve around its peripheral surface to such a degree that there is hardly any play in the radial direction. In this manner, the rotary knob and thus the adjustment member are completely protected against lateral knocks.

Further advantages emerge from the description and the accompanying drawing.

It will be appreciated that the features mentioned above and those still to be described below are not merely usable in the respectively indicated combinations but also in other combinations or in isolation without departing from the scope of the present invention.

An example embodiment of the invention is illustrated in the drawing and described in more detail in the description below. In the drawing.

Figure 1:
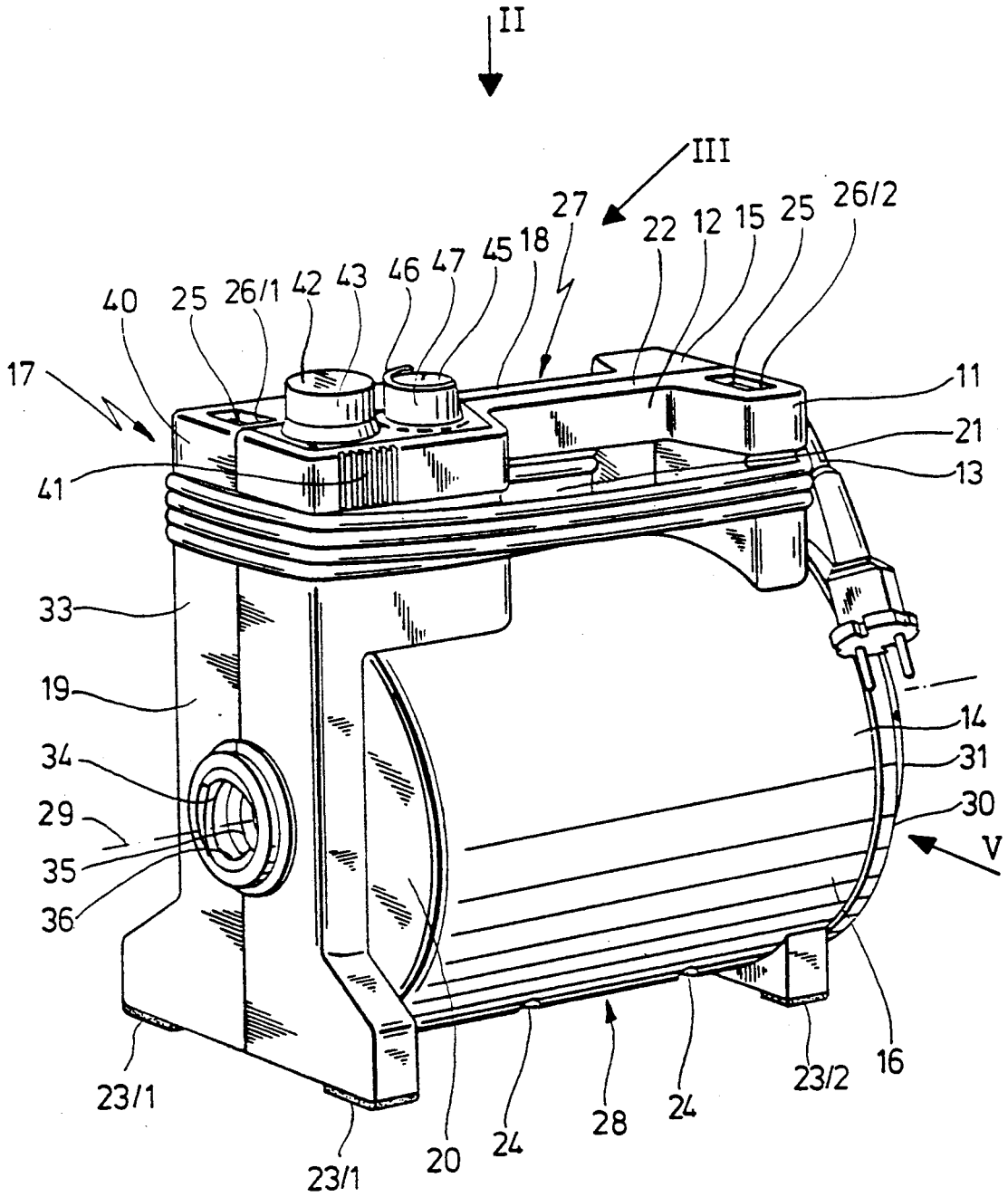
FIG. 1 shows the inventive compressed-air generator in a perspective illustration.

In FIG. 1, a compressed-air generator is designated 8 and in the example shown is a motor fan 10. The motor fan 10 has a two-part housing 11, a handle 12 and an electrical connecting cable 13. The housing 11, which may for example be of plastics material, includes a housing shell 14, on the right in FIG. 1, and a housing shell 15, on the left in FIG. 1. The housing shells 14 and 15 are placed one on the other by means of their open sides and receive between them, in their cylindrical housing cavity 16 which is thus formed, a fan motor which is not shown in more detail. The fan motor is provided with electrical energy via the connecting cable 13.

Provided on the housing 11 is an L-shaped bracket 17 whereof the upper arm 18 extends above the housing cavity 16, while the lower arm 19 thereof is arranged against the housing cavity 16 such that it lies against the end side 20 thereof. The upper arm 18 is narrowed approximately in the middle to form a web 22, with a free space 21 being provided between the web 22 and the housing cavity 16. In this manner, a hand is to grasp completely around the web 22, which forms the handle 12.

At its lower end remote from the upper arm 18 the front arm 19 merges with feet 23/1. The housing cavity 16 carries at its rear end remote from its end side 20 further feet 23/2 which are at the same height as the feet 23/1.

The two housing shells 14 and 15 are connected to one another by a snap-on mechanism (not shown), two screws 24 and four further screws (also not shown). For insertion of a carrying strap (also not illustrated), there serve two pins 25 which are respectively arranged in an elongate recess 26 and provided on the two housing shells 14 and 15 in the region of their top side 27. The screws 24 hold the housing shells 14 and 15 together at their lower side 28. The top side 27 and the lower side 28 of the housing shells 14 and 15, needless to say, correspond to the top side and the lower side respectively of the motor fan 10 and are accordingly provided with the same reference numerals.

Of the two elongate recesses 26, one is respectively provided on the right-hand housing shell 14 and one on the left-hand housing shell 15. Seen in the longitudinal direction 29 of the motor fan 10, the recesses 26, which run transversely to the longitudinal direction 29, are remote from one another in such a way that the recess 26/1 provided on the left-hand housing shell 15 is arranged in the region of the end side 20 while the recess 26/2 provided on the right-hand housing shell 14 is arranged on the motor fan 10 such that it extends in the region of its rear side 30. As can be seen from FIG. 1, the web 22 runs between the recesses 26/1 and 26/2, although somewhat more towards the rear recess 26/2.

Figure 2:
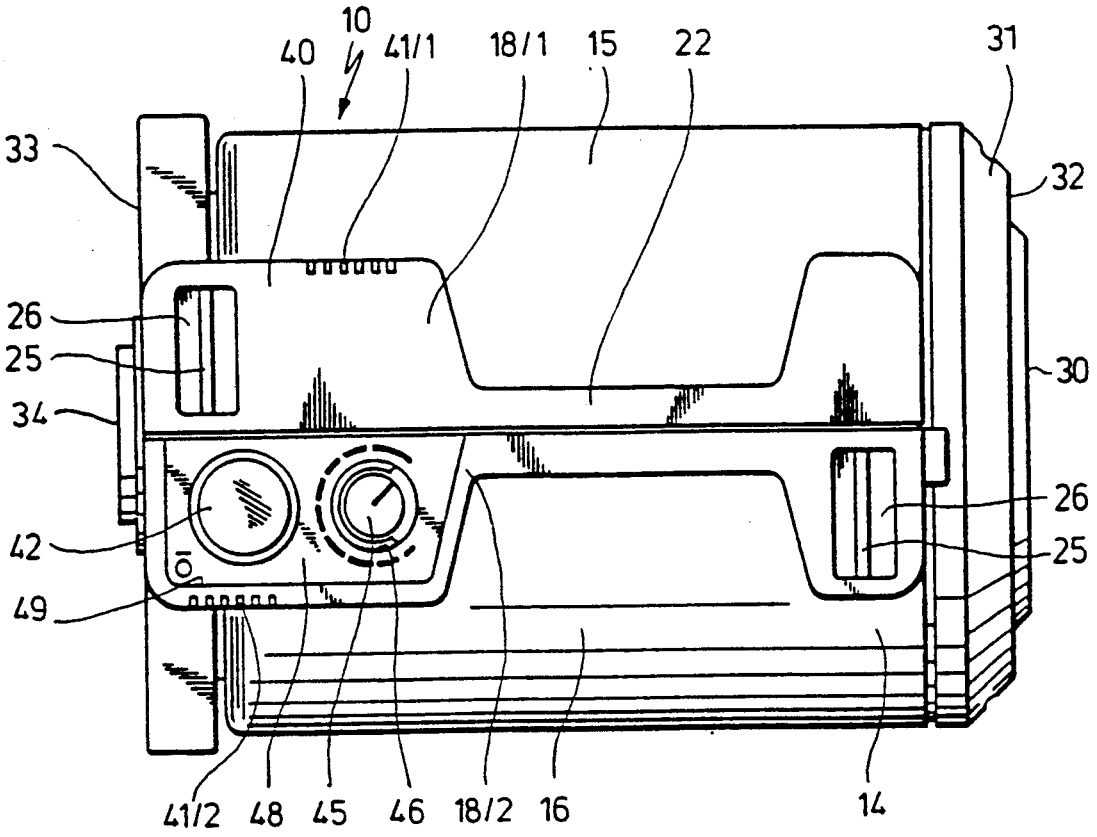
FIG. 2 shows the compressed-air generator of FIG. 1 in a plan view in the direction of the arrow II in FIG. 1.

A cover 31, which can be seen more clearly in FIG. 2, and in which an annular air inlet slot 32 is provided, is placed on the housing cavity 16 at the rear side 30. Returning to FIG. 1, it can further be seen that the motor fan 10 has on its front side 33 remote from the rear side 30 a compressed-air outlet 34 located in the front arm 19, pointing away from the end side 20 and in the form of a projecting annular attachment, in the opening 35 of which there is an internal thread 36. A compressed-air hose, not shown for reasons of clarity, is screwed into the opening 35 in known manner.

As can be seen in particular in the side view of FIG. 5, the connecting cable 13 emerges below the web 22 from a rear transverse web 37 of the upper arm 18 and points forward. For winding up the connecting cable 13 projecting into the free space 21, longitudinal grooves 38 are provided on the upper arm 18 running around the latter in the longitudinal direction, these longitudinal grooves 38 being matched to the diameter of the connecting cable 13. In order to keep the connecting cable 13 in the wound-up position, a holding clip 39 pointing backwards is provided on the transverse web 37 above the longitudinal grooves 38. The wound-up connecting cable 13 is clamped into this holding clip 39 so that it is held as shown in FIG. 1.

Two blow-out openings 41 are provided in the upper arm 18 in the region of its front section 40, and air which has been fed, for cooling of an electronic control circuit (not shown in more detail), via a bypass to this control circuit is blown out of the two blow-out openings 41. The control circuit serves to regulate the speed of the fan motor in a manner known per se.

In the region of the front section 40, a press switch 42 is provided on the top side 27 of the motor fan 10 and serves to switch the motor fan 10 on and off. As a protection against sprayed water or the like, a protective cap 43 of plastics material is drawn over the press switch 42. A rotary knob 45 which is partially surrounded by a protective sleeve 46 which will be described in more detail below is arranged behind the press switch 42, as seen in the longitudinal direction 29. The protective sleeve 46 serves as a protective apparatus 47 for an adjustment member to be actuated via the rotary knob 46 and associated with the control circuit.

As can be seen more clearly from FIG. 2, the press switch 42, the protective sleeve 46 and the rotary knob 45 are arranged on a base plate 48. The base plate 48 is set in a depression 49 which is provided in the top side 27 of the right-hand housing shell 14.

Because the housing 11 comprises two housing shells 14 and 15, each made in one piece from plastics material, the upper arm 18, for example in the same manner as the housing cavity 16, is composed of two halves. The left-hand half arm 18/1 is associated with the left-hand housing shell 15 and the right-hand half arm 18/2 of the upper arm 18 is associated with the right-hand housing shell 14. As can be seen from FIG. 2, the depression 49 is provided in the right-hand half arm 18/2. Before assembly of the housing 11, the base plate 48 is inserted in the depression 49, where it is held on joining of the housing 11 by the front section 40 of the left-hand half arm 18/1. After the housing 11 has been screwed together, the base plate 48 is thus connected to the housing 11 with form fit.

Figure 3:
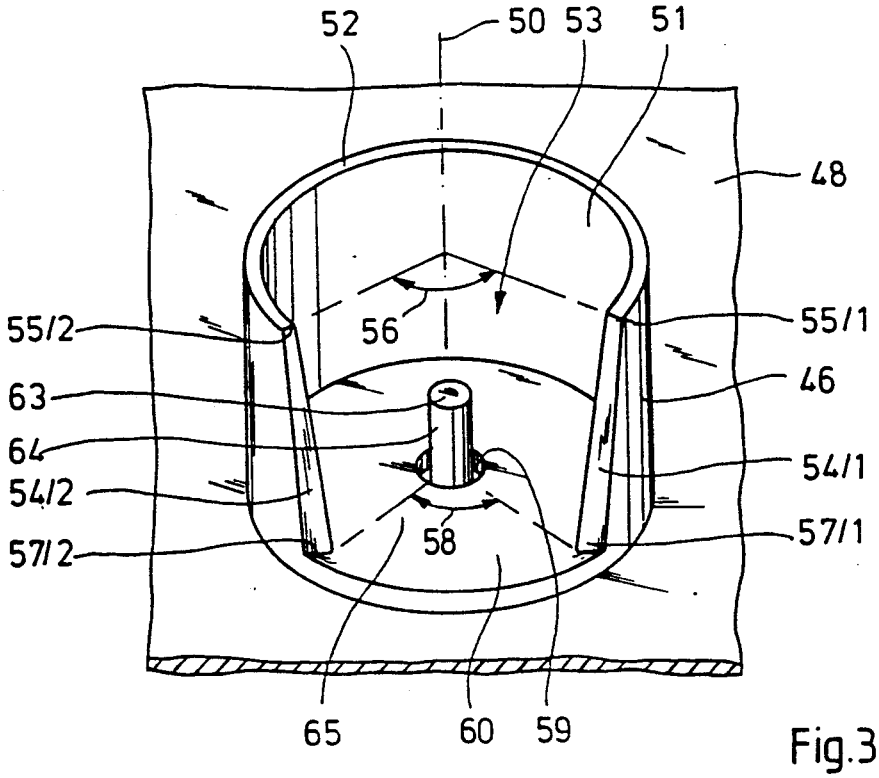
FIG. 3 shows a perspective illustration of the protective sleeve with the adjustment member indicated, in an opened-up illustration in which the rotary knob has been omitted, in an illustration in the direction of the arrow III in FIG. 1.

FIG. 3 illustrates, as seen in the direction of the arrow III in FIG. 1, the protective sleeve 46, which is made in one piece with the base plate 48 from a shock-resistant plastics material. For reasons of clarity, the rotary knob 45 has been omitted and the base plate 48 truncated.

The protective sleeve 46, in the shape of a hollow cylinder, has a wall 51 extending symmetrically with respect to its longitudinal axis 50 and pointing away from the base plate 48 at its end side 52. Provided in the wall 51 is a V-shaped cutout 53 which is limited by two oblique end surfaces 54 of the wall 51. The V-shaped cutout 53 extends, at its upper section 55 remote from the base plate 48, over an angular region 56 of approximately 110° with reference to the longitudinal axis 50. At its lower section 57 against the base plate 48, the cutout 53 extends over a correspondingly dimensioned angular region 58 of approximately 90°.

Provided in the base plate 48 is a central bore 59 which passes through the bottom 60 thereof in the longitudinal direction 50. A shaft 63 of an adjustment member 64 (not shown in further detail) is pushed through the opening 59 from below and is screwed to the bottom 60 by a swivel nut (also not shown). The opening 59 and the bottom 60 thus serve as a holding means 65 for the adjustment member 64.

Figure 4:
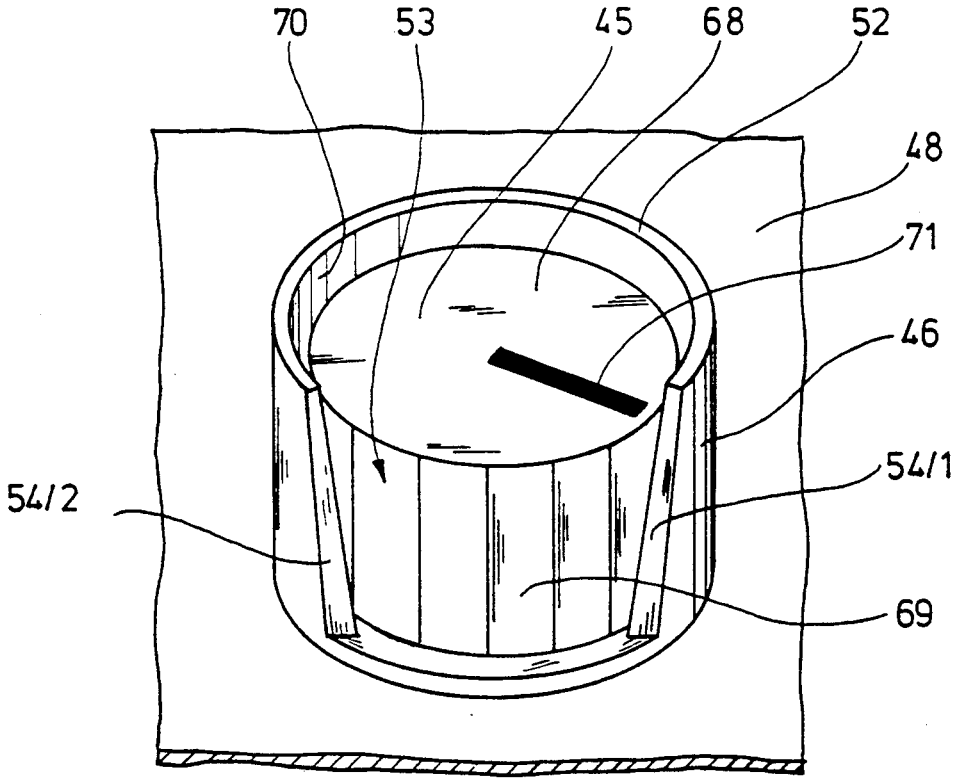
FIG. 4 shows an illustration like that of FIG. 3 but with the rotary knob placed in the protective sleeve.

The rotary knob 45 is pushed onto the shaft 63 in known manner and secured thereto. FIG. 4 shows the rotary knob 45 placed in the protective sleeve 46.

It can be seen that the top side 68 of the rotary knob 45 lies below the end side 52 of the protective sleeve 46. The rotary knob 45, which is knurled on its outer peripheral surface 69, may on the one hand be turned from the outside through the V-shaped cutout 53, but on the other hand it can only be removed from the protective sleeve 46 in the longitudinal direction 50. In the radial direction, the protective sleeve 46 surrounds the rotary knob 45 by means of its inner surface 70 to such an extent that the rotary knob 45 cannot be moved out of the protective sleeve 45 laterally. On the other hand, the inner wall 70 bears against the outer peripheral surface 69 so closely that it is not possible to tilt the rotary knob 45 in the protective sleeve 46.

Figure 5:
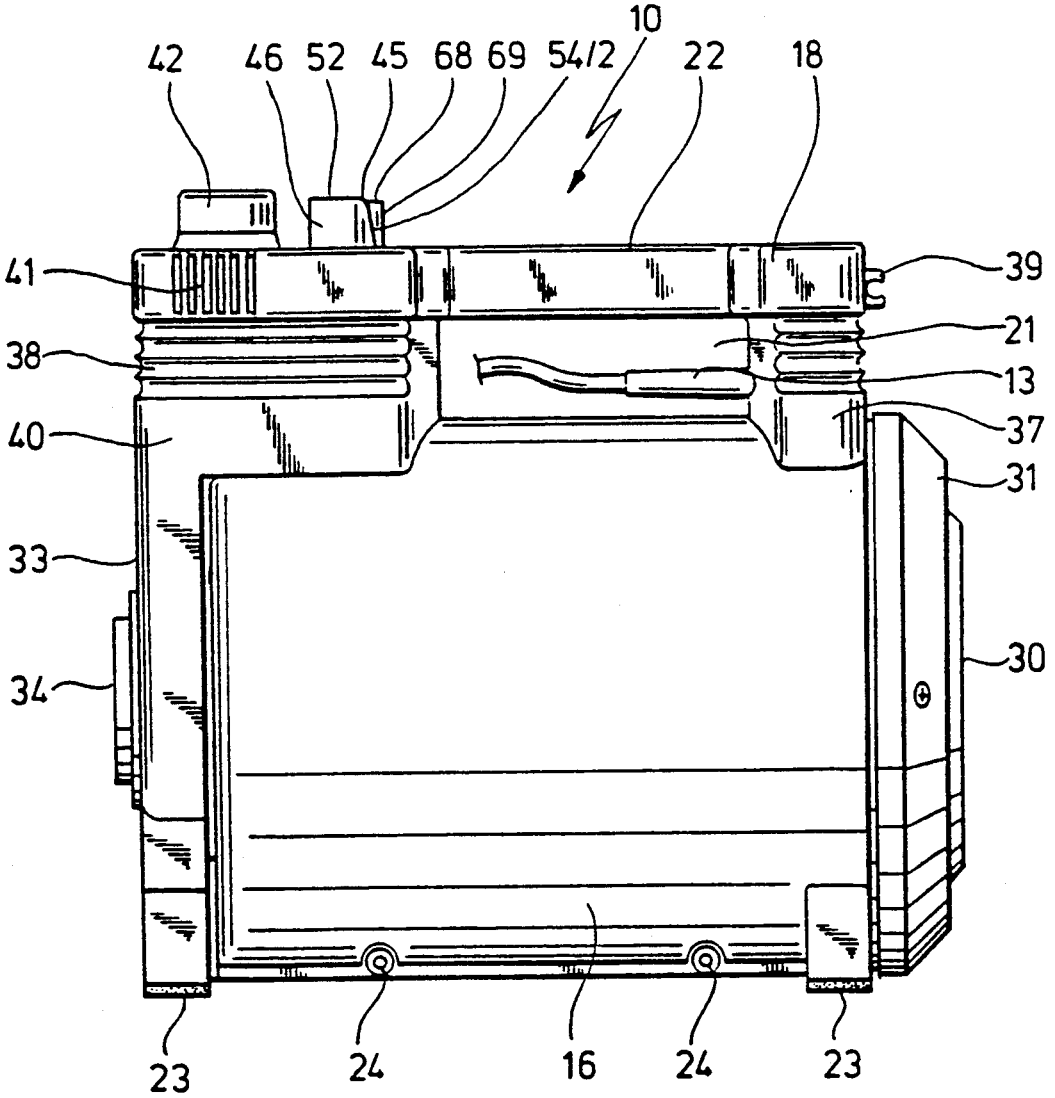
FIG. 5 shows the compressed-air generator of FIG. 1 in a side view in the direction of the arrow V in FIG. 1.

As can best be seen from FIG. 5, the rotary knob 45 projects out of the protective sleeve 46 slightly in the direction of the handle 12 or of the web 22, so that it can be turned by gripping its peripheral surface 69. Here, the user's finger bears against the peripheral surface 69 and against the oblique end surfaces 54.

Since the protective sleeve 46 is open to the top, a mark designated 71 in FIG. 4 makes it possible to perform a visual check of the adjustment of the rotary knob 45 and thus of the adjustment member 64. The adjustment member 64 is part of the electronic control circuit mentioned above. By turning the rotary knob 45 and thus the shaft 63, the adjustment member 64 is affected such that the electronic control circuit establishes a desired speed of the fan motor. The speed of the fan motor sets the air throughput taken in through the air inlet slot 32 and/or the pressure output given out at the compressed-air outlet 34.

I claim:

1. A compressed-air generator, comprising:

a housing;

a fan motor arranged in said housing below a top side thereof;

adjustment means controlled by a rotary knob for adjustment of said fan motor, said rotary knob having a longitudinal axis and a peripheral surface thereabout and being arranged on said top side of said housing; and protection means for covering said rotary knob, said protection means including a protective sleeve essentially surrounding said rotary knob at said peripheral surface and being connected to said housing with form fit, said protective sleeve, further, having a continuous wall provided with an upwardly widening V-shaped cutout through which a section of said rotary knob peripheral surface is accessible from outside, said protective sleeve projecting upwardly beyond said rotary knob in a direction of said longitudinal axis.

2. The compressed-air generator of claim 1, wherein said protective sleeve is made in one piece from a shock-resistant material.

3. The compressed-air generator of claim 1, wherein said peripheral surface of said rotary knob is fluted and said V-shaped cutout extends at an upper section thereof over an angular region of less than 130°, with respect to said longitudinal axis, and at a lower section thereof over a correspondingly dimensioned angular region of less than 100°.

4. The compressed-air generator of claim 1, wherein a handle is provided on said top side of said housing between a front side thereof and a rear side thereof, said protective sleeve is arranged in a region of said front side, and wherein said cutout is aligned in a longitudinal direction of said housing and points towards said handle.

5. The compressed-air generator of claim 4, wherein said adjustment means is cooled by way of an airstream for which at least one blow-out opening pointing laterally away from said handle is provided on said housing.

* * * * *

UNITED STATES PATENT AND TRADEMARK OFFICE

CERTIFICATE OF CORRECTION

PATENT NO. : 5,156,530

DATED : October 20, 1992

INVENTOR(S) : Eugen Rutschle

It is certified that error appears in the above-identified patent and that said Letters Patent is hereby corrected as shown below:

Col. 2, line 46: the (should be)
the adjustment member.

Signed and Sealed this

Twenty-sixth Day of April, 1994

Bruce Lehman

*Attest:*

BRUCE LEHMAN

*Attesting Officer*

*Commissioner of Patents and Trademarks*